US005177918A

United States Patent [19]

Chang

[11] Patent Number: 5,177,918

[45] Date of Patent: Jan. 12, 1993

[54] WALL STRUCTURE

[76] Inventor: Fu-Chuan Chang, 4D-11 Taipei World Trade Centre, No. 5, Hsin Yi Rd., Sec. 5, Taipei, Taiwan

[21] Appl. No.: 748,090

[22] Filed: Aug. 21, 1991

[51] Int. Cl.[5] ..... E04H 2/00

[52] U.S. Cl. ..... 52/252; 52/346; 52/443; 52/333; 52/334

[58] Field of Search ..... 52/333, 334, 443, 346, 52/347, 252

[56] References Cited

U.S. PATENT DOCUMENTS 2,026,117 12/1935 Balduf ..... 52/346

FOREIGN PATENT DOCUMENTS 0530503 9/1956 Canada ..... 52/443

*Primary Examiner*—David A. Scherbel
*Assistant Examiner*—Wynn E. Wood
*Attorney, Agent, or Firm*—Bacon & Thomas

[57] ABSTRACT

A shock-absorption wall structure comprising a framework of elastic beams having a light steel frame covered with a certain number of base plates is disclosed. The base plates have at least two or more rows of parallel sheets in the upper/lower sides or left/right sides and a plurality of inclined sheets and/or rolling sheets to make paving slurry even and quick, and enable the slurry to evince a strong adhesive force. Each elastic beam includes a pair of truss bodies interconnected by number of long bolts and springs with each long bolt penetrating through a respective pair of truss bodies. The springs are accommodated within the truss body and then a cover plate is attached on one side of the elastic beam. By this arrangement, the internal stress of the wall arising from an earthquake or working vibration can be absorbed by each spring to prevent the wall from cracking or collapsing.

4 Claims, 5 Drawing Sheets

WALL STRUCTURE

FIELD OF THE INVENTION

The present invention relates to a wall structure and particularly to a shock-absorption wall that is convenient in construction, with a firm structure, capable of absorbing structural stress and managing cracks.

BACKGROUND OF THE INVENTION

Generally speaking, most of the wall forming structures according to conventional light steel framing technology comprise plaster plates or cement plates secured to a framework of light steel frame, etc. so as to form a hard partition wall top. Such prior art arrangements suffer from the following drawbacks: their structure lacks straining buffer action, resulting in structural incompleteness and poor durability; and in the event of an earthquake or vibration due to working, pressure on the main girder cannot be eliminated from the rigid wall top structure so the wall top is likely to crack or break and collapse to cause injury. Thus, such structures can constitute a serious menace to a residence. Besides, a lot of money would have to be spent for repair or reconstruction.

In view of various the defects found in conventional light-steel framing wall top structures and their construction, these exists a need for an improved structural wall arrangement that can overcome these problems.

SUMMARY OF THE INVENTION

One object of the present invention is to provide a shock-absorption wall top with a buffer stress effect and a better safety design.

Another object of the present invention is to provide a shock-absorption wall top that minimizes or prevents cracks due to vibration within the cover plates around the wall top.

Another object of the present invention is to provide a shock-absorption wall top having horizontal/parallel sheets, inclined sheets or rolling sheets on a one-piece base plate in order to prevent wasted time, labor and money, poor durability, etc. associated with conventional construction methods.

Another object of the present invention is to provide a shock-absorption wall top that has high strength and better shock resistance characteristics.

These and other objects and advantages of the present invention will become more readily apparent to those skilled in the art from the following detailed description of a preferred embodiment thereof when taken in conjunction with the accompanying drawings.

DETAILED DESCRIPTION OF THE PREFERRED EMBODIMENT

Figure 1:
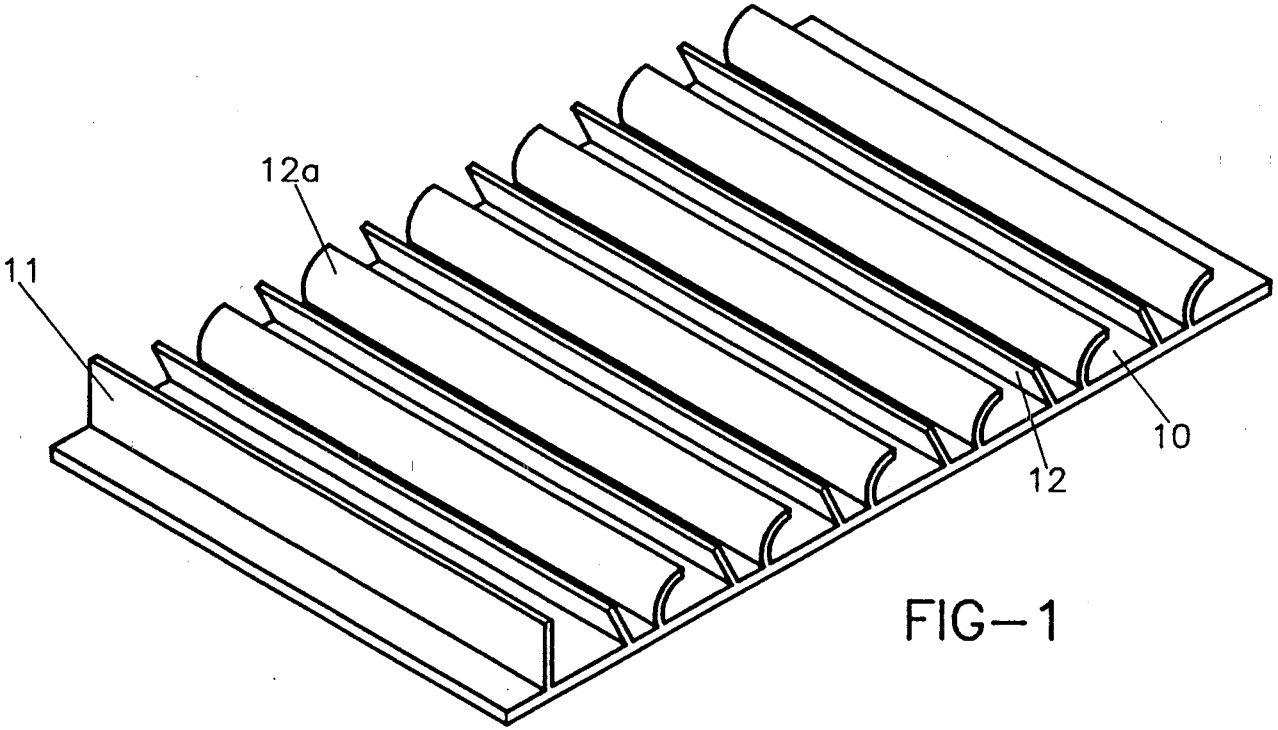
FIG. 1 is an elevational view of a base plate constructed according to the present invention.

Referring to the drawings, the shock-absorption wall of the present invention comprises a certain number of metal base plates 10, shown as having a rectangular shape. At a predetermined distance from the base plate 10, a parallel sheet 11 is secured along a side end and erected on the base plate 10 whereby the parallel sheet 11 provides a datum height for cement pavement. A certain number of inclined sheets 12 are mounted at spaced intervals along base plate 10. Inclined sheets 12 generally extend in the direction of parallel sheet 11. Each of the inclined sheets 12 are mounted obliquely on the base plate 10 and extend therefrom lower than the height of parallel sheet 11. Further, inclined sheets 12 obliquely extend toward respective ends of base plate 10 in an alternating fashion. It should be noted that the distance between two inclined sheets 12 must be kept appropriate so as to enable the root portion of the inclined sheets 12 to be filled with cement. Besides, to increase adhesive forces, some inclined sheets 12 may be located adjacent to a curved or rolling sheet **12*a* (refer to FIGS. 1 and 2**).

Figure 2:
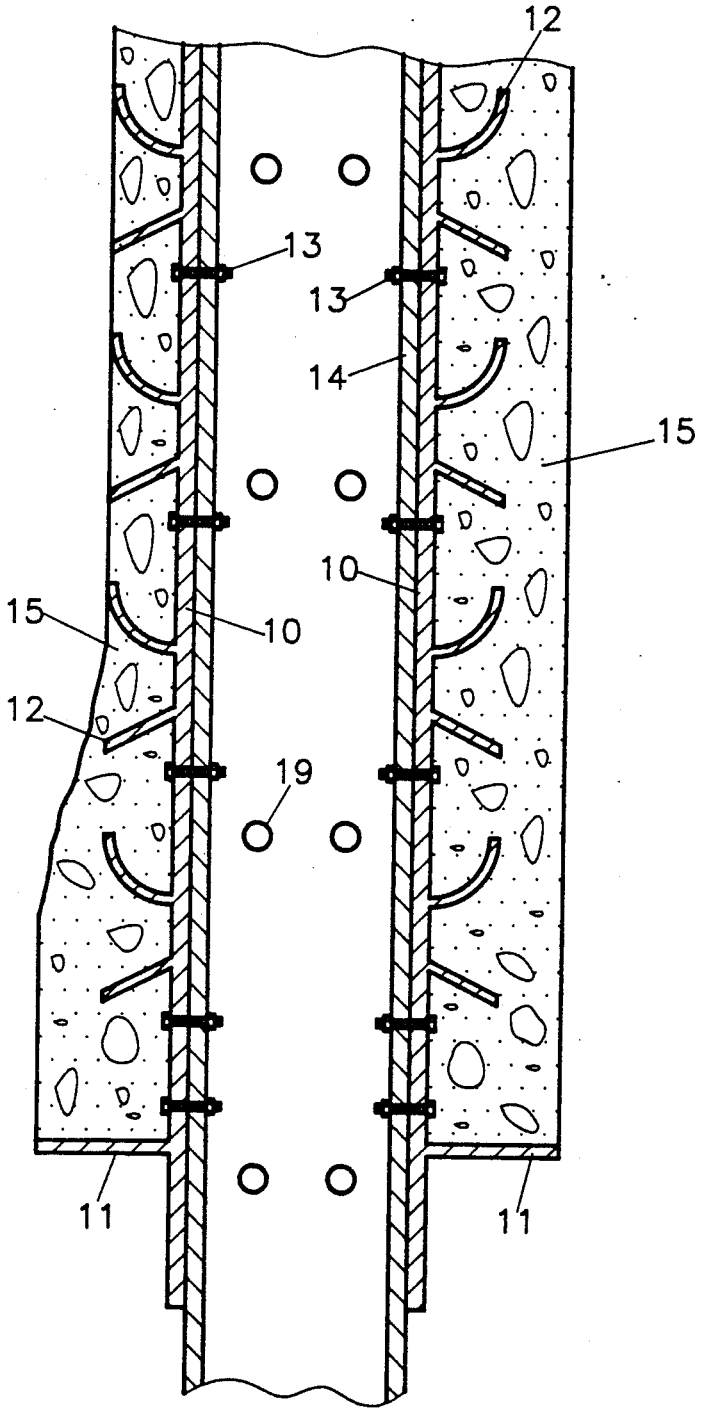
FIG. 2 is a partial cross-sectional view of the base plate and elastic beams assembled according to the present invention.

The orientation of base plate 10 depends on its specified use. That is to say, the constructor may mount parallel sheets 11 at the upper/lower sides for the wall depending upon the specific jobsite working condition. During construction, a base plate 10 is assembled with a screw 13 or similar solid-joint fastener element to both sides of beam 14 as best shown in FIG. 2. Thereafter, a finish slurry 15 is applied against base plate 10 so that slurry 15 covers each inclined sheet 12 and rolling sheet **12*a* first. Then additional pavement can be applied while using parallel sheet 11 as a datum height (thickness) for paving slurry 15. In this manner, it is rather easy to accomplish the goal of quick construction with accurate pavement (refer to FIG. 2**).

By using base plates 10 for paving slurry in this manner, it enables: (1) the construction worker to make an estimate on the height (thickness) of the pavement in advance by means of parallel sheet 11 in order to minimize working error and material waste whereby a better performance is attained; (2) the inclined sheet 12 and rolling sheet **12*a* to provide ideal holding force and adhesive force for readily cement binding the base plate 10 firmly, which provides excellent shock-proof characteristics with respect to the structural strength of a whole building; and (3) the base plate 10 to be built up at the sides of the beam 14** to form appropriate spacing therebetween which is convenient for extending indoor or floor-to-floor pipelines therethrough as well as to make for easy service in the future.

In practical operation, the weight of base plate 10 and slurry 15 is borne by the beam. Increased firmness and stability can be accomplished by means of providing more screwing points or using a direct welding method, which really concerns the selection of an appropriate method only and by no means presents a structural problem. Further, since inclined sheets 12 and rolling sheets **12*a* having shorter lengths and are slightly inclined, not only does this provide the base plate 10 with an increased holding force against slurry 15** to provide a firm binding effect, but also aids cement pavement whereby a convenient construction method is achieved.

Figure 3:
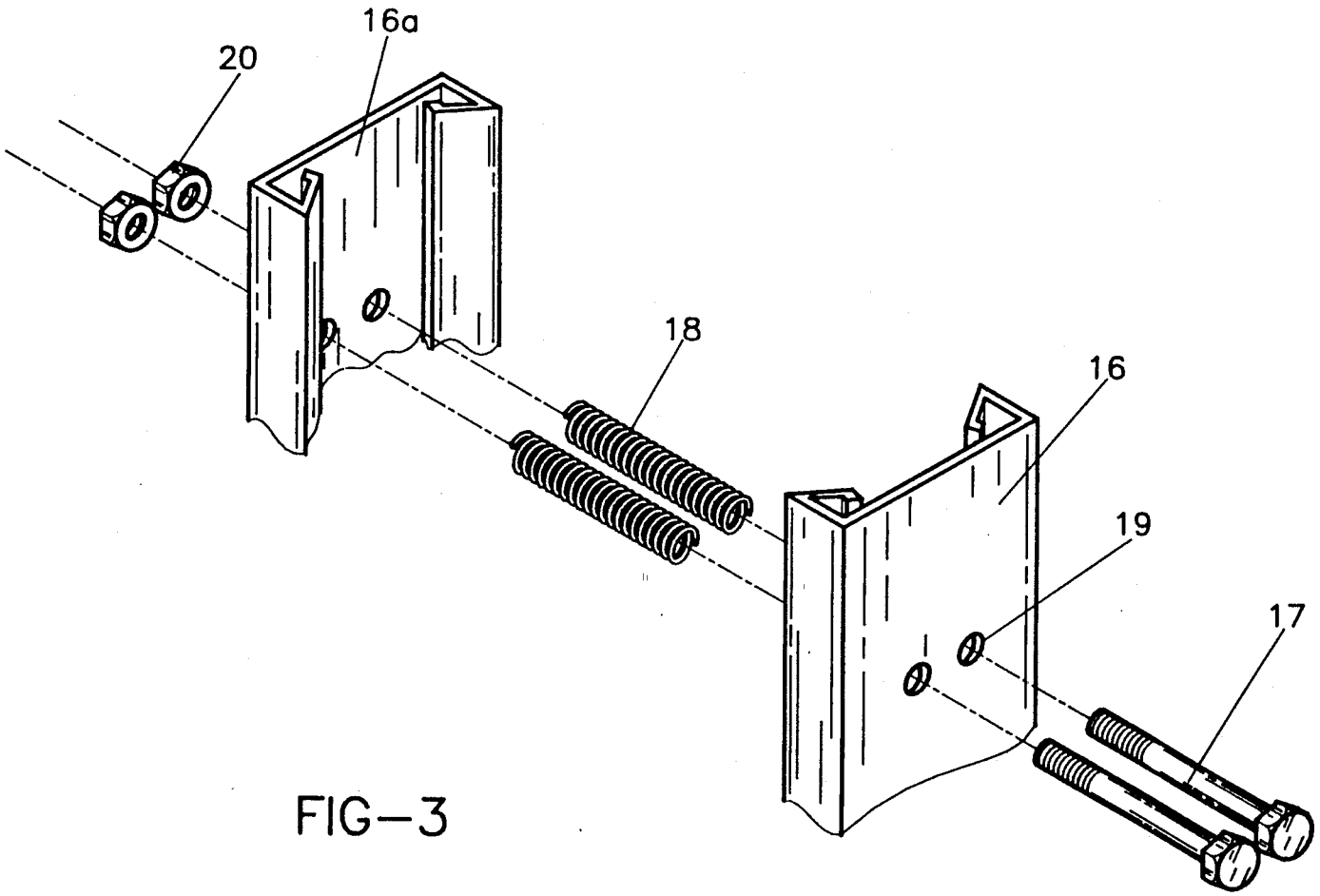
FIG. 3 is an exploded view of the elastic beams constructed according to the present invention.

Referring to FIG. 3, elastic beam generally includes a pair of frame bodies 16 and **16*a* which are interconnected by a certain number of long bolts 17, a corresponding number of screw springs 18 (wherein the long bolt 17 goes through the frame body 16 and 16***a* and the screw spring 18) and nuts 20. This construction enables elastic beam to provide for shock absorption while minimizing wall cracks, etc. by means of elastic compression of springs 18.

The frame body 16 resembles a long plate shape, with a generally U-type longitudinal cross-section, and is mounted with opening sides face to face. A certain number of round holes 19 are provided on the opposite side for receiving the long bolts 17 therethrough. The end of each of the long bolts 17 extends through frame bodies 16 and 16*a* and a nut 20 is secured thereto to accomplish the initial assembly of frame bodies 16 and 16*a*.

The screw springs 18 are mounted between the frame bodies 16 and 16*a* concentric with the non-threaded section of the long bolts 17 so as to compress the screw spring 18 and to enable frame bodies 16 and 16*a* to remain parallel (refer to FIG. 3) by means of the release force of each spring 18 functioning to provide a sidewise thrust to the frame bodies 16 and 16*a*.

Figure 4:
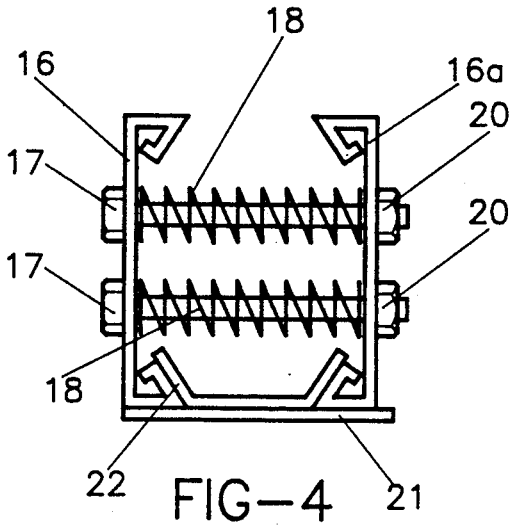
FIG. 4 is a side view of the elastic beams and cover plate.
Figure 5:
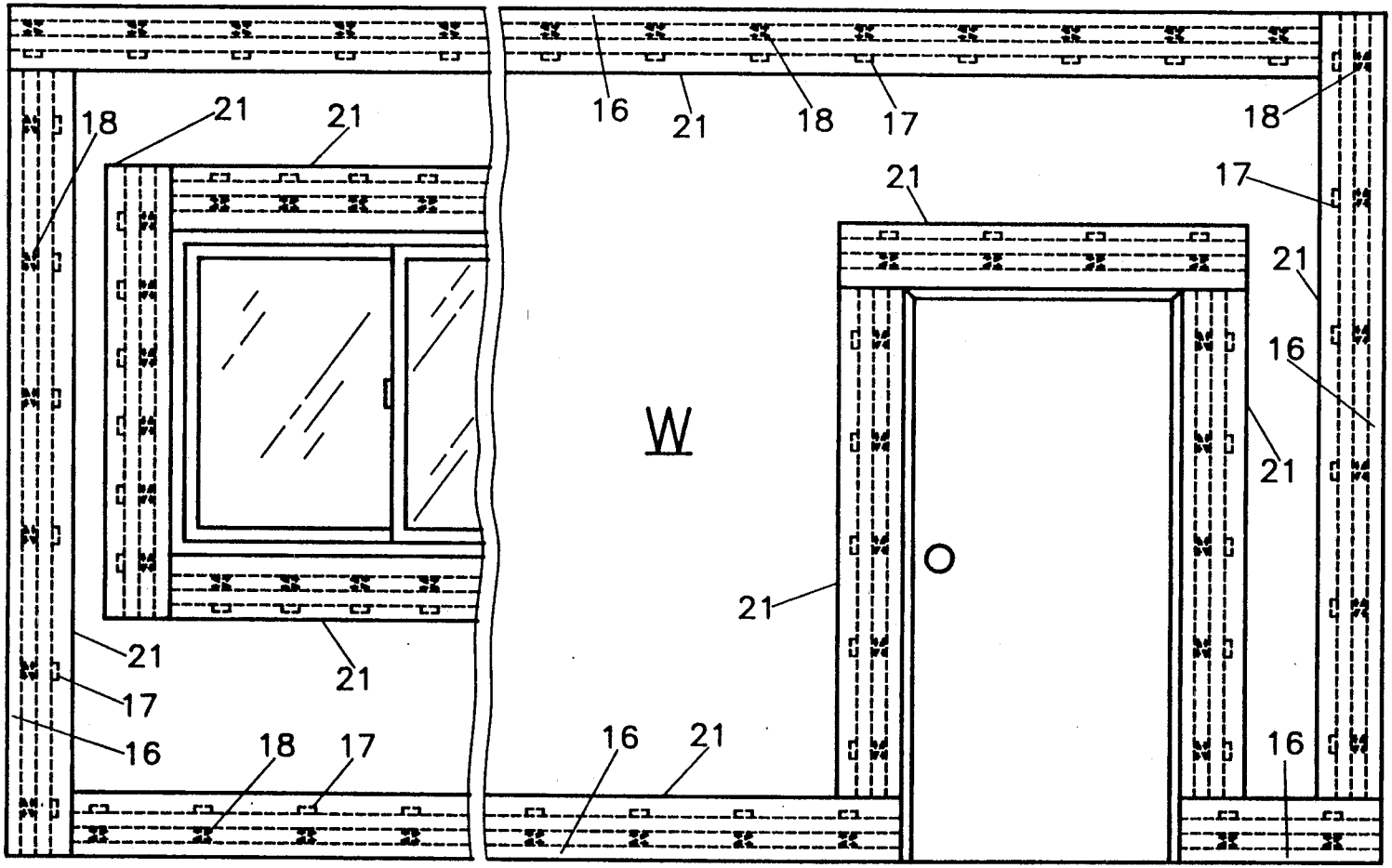
FIG. 5 is a front view of the present invention in use.

A cover plate 21, as best shown in FIGS. 4 and 5, is generally rectangular in shape and its length matches the length of frame body 16 and its width is greater than the width of elastic beam (see FIG. 4). The rear side of cover plate 21 has secured thereto a predetermined number of elastic strips 22 which are adapted to extend into the spacings on the side of each frame body 16 and 16*a*. Therefore, cover plate 21 is removably secured on a side of the elastic beam by means of elastic strips 22. Cover plate 21 is not necessary for paving slurry but functions to form the frame of the wall (refer to FIG. 5).

When the elastic beams are erected into a frame shape and then attached to the base plate 10, the slurry or cement is sprayed or otherwise applied on the base plate 10 to form a wall. It should be noted that an appropriate spacing (refer to FIG. 5) must be reserved at the perpendicular angle between a longitudinal beam and a horizontal beam 14 to enable the elastic beams to absorb longitudinal or horizontal pressure. In addition, at doors or windows used or vibrated very often, the elastic beams 14 can be mounted sidewise. When vibration occurs, if the interiors of wall is loaded with a lateral pressure (or on an X axis) stress shall be delivered to the longitudinal elastic beams to force the springs 18 within the beam elastic beam to compress and absorb the stress. On the other hand, if stress is caused longitudinally, it will be absorbed by horizontal beams. If the vibration amplitude is great, the stress will increase accordingly and perhaps will result in slurry cracks on the wall. However, when the base plate 10 and beam 14 of the invention are utilized the cracks will be confined within the sides of wall (the junction between the beam 14 and slurry) to prevent the cracks from spreading irregularly and, more specifically, the cracks will be hidden within the cover plate 21 whereby the direction of the cracks can be so controlled to minimize the possibility of the wall collapsing, advance building safety during vibration occurrence, and further enable easy repair in the future. In addition, the space inside the beam 14 may be filled with elastic paint or elastic fire-proof materials as well as reserved for water and wire piping. In this case, for any water or power facility repair thereafter, it is only necessary to remove the cover plate 21.

Figure 6:
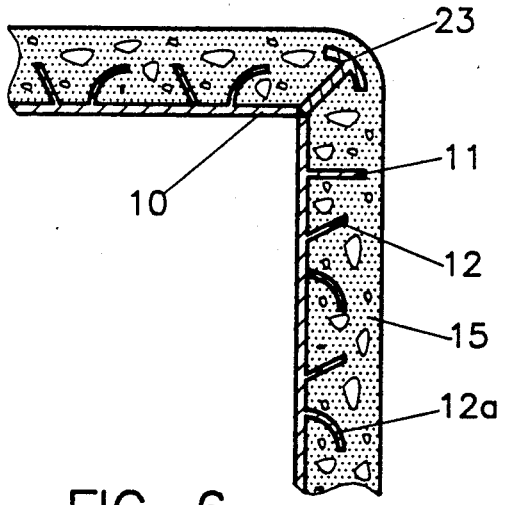
FIG. 6 is a partial cross-sectional view of the base plate according to the present invention used in a corner portion.

When the base plate 10 is positioned at the beam 14, the junction between perpendicular and horizontal base plates 10 forms the corner of the wall. An angle element 23 (refer to FIG. 6) may be connected by welding or similar method at this location. The angle element has an arrow-shaped section and its head faces outward, and the height is designed relative to the height of parallel sheets 11 of the base plate 10 to provide a reference thickness for the filling slurry, and further makes for more convenient corner construction and angle modification.

Many changes, modifications, variations and other uses and applications of the present invention will, however, become apparent to those skilled in the art after considering the foregoing specification together with the accompanying drawings. All such changes, modifications, variations and other uses and applications which do not depart from the spirit and the scope of the invention are deemed to be covered by the invention which is limited only by the claims which follow.

What is claimed is:

1. A wall structure capable of absorbing vibrational shocks comprising:

a plurality of elongated beam assemblies adapted to be arranged to form a framework of the wall structure, each of said beam assemblies including a pair of beam units resiliently joined together;

a plurality of base plate members adapted to be fixedly secured between respective ones of said beam assemblies, each of said base plate members including a base, at least one parallel sheet extending substantially perpendicular to said base, and a predetermined number of inclined and curved sheet members extending from and spaced along the length of said base, wherein said at least one parallel sheet extends from said base a distance defining a datum thickness for a slurry adapted to be applied to said base plate members; and a plurality of elongated cover plates, each of said cover plates including at least one elastic fastening member secured to one side thereof for removably attaching the cover plate to a respective one of said beam assemblies,

2. A wall structure as claimed in claim 1, wherein each of said beam units are generally U-shaped in longitudinal cross-section and wherein each of said beam assemblies further includes a plurality of fasteners for securing respective pairs of beam units together with a plurality of springs therebetween such that the beam units of each beam assembly are biased apart by the springs but are retained together by the plurality of fasteners.

3. A wall structure as claimed in claim 1, wherein said at least one parallel sheet extends from said base a distance greater than said inclined and curved sheets.

4. A wall structure as claimed in claim 1, further including at least one angle element fixedly secured at an end of at least one of said base plate members, each of said angle elements being adapted to be arranged in a corner of said wall structure and extending from a corresponding one of said base plate members a height substantially equal to said at least one parallel sheet.

* * * * *